United States Patent [19]

Davis et al.

[11] Patent Number: 4,733,893

[45] Date of Patent: Mar. 29, 1988

[54] TRANSPARENT SECURITY SEAL

[75] Inventors: George W. Davis, Warren; Frank P. Aadahl, Bound Brook, both of N.J.

[73] Assignee: Inner-Tite Corporation, Springfield, N.J.

[21] Appl. No.: 33,996

[22] Filed: Apr. 2, 1987

[51] Int. Cl.[4] ..... B65D 33/34

[52] U.S. Cl. ..... 292/320

[58] Field of Search ..... 292/320, 318, 319, 321, 292/322, 323

[56] References Cited

U.S. PATENT DOCUMENTS

| | | | |
|---|---|---|---|
| 3,375,033 | 3/1968 | Moberg | 292/320 |
| 3,980,332 | 9/1976 | King, Sr. | 292/320 |
| 4,254,977 | 3/1981 | Guiler | 292/320 |

*Primary Examiner*—Richard E. Moore

*Attorney, Agent, or Firm*—McCormick, Paulding and Huber

[57] ABSTRACT

A seal for utility meters and the like has a generally hollow pendular transparent body with two openings spaced along its upper surface connecting with a central cavity. An opaque plastic locking member is inserted into the cavity and permanently connected to the body. For locking the seal irreversibly, a generally U-shaped fastening shackle, each end of which is reversibly bent to form a tang, is inserted through the openings in the upper surface of the body down into the cavity and into locking engagement with the body and the locking member. Frangible fingers and leaves formed in the locking member are designed to provide visual evidence of any attempt to tamper with the seal whether successful or not.

9 Claims, 7 Drawing Figures

TRANSPARENT SECURITY SEAL

BACKGROUND

This invention relates to seals for utility meters and the like and, more particularly, to a single-use seal designed to permit easy detection of any tampering whether successful or not.

Seals to discourage tampering with utility meters, shipping containers, boxcars and the like are well known. While such seals are made from a variety of designs, they may be classified generally into two types: multi-use seals and single use seals. Multi-use seals contain a number of parts, including a casing, a shackle adapted for interlocking engagement with the casing and a locking member designed to effect the locking engagement of the shackle with the casing. The locking member of such a seal is usually breakable in some manner, which permits removal of the shackle from locking engagement with the casing and the meter, and reuse of the casing and shackle. Multi-use seals of this construction disclosed in U.S. Pat. No. 998,878 and U.S. Pat. No. 3,980,332 having the same assignee as the present invention.

Single-use seals usually employ a unitary housing comprising the casing and the locking member. After the shackle is locked within the housing, it cannot be removed without destroying the seal. A seal of this general design is disclosed in U.S. Pat. No. 4,353,583. Often, the housing is made of some frangible material, and the seal is broken by shattering the housing with a sharp blow. Seals of this design are disclosed in U.S. Pat. Nos. 511,642 and 367,877.

All of the prior art seals have at least one substantial drawback that limits their utility. Whether a seal is of the multi-use or single-use type, where its housing or casing is composed of an opaque material, the seal may be subject to undetectible tampering. For example, the shackle may be cut flush with the housing or casing to permit removal of the seal. After the meter or the like has been meddled with or reset, the seal may again be installed by reforming the tip of the shackle and reinserting it into the casing or housing.

Even where a seal is made from some transparent material, it may be tampered with without detection. In some cases a continuous tensile force applied to the shackle causes its tips to deform and pull out of the casing or housing of the seal. The shackle may then simply be reformed and reinserted. In other cases a thin rigid member or "pick" may be inserted into the housing or casing to deform the tip of the shackle thus allowing its removal. Again, the tip merely has to be reformed and reinserted.

Where a multi-use seal comprising several parts is employed, cannibalization becomes a serious problem. The seal may be broken, the meter or the like meddled with or reset and the seal reinstalled using parts taken from other seals of the same design.

In certain instances seals have been composed of some frangible material designed to break when the seal is tampered with. While such seals indeed disclose attempts at tampering, they cannot achieve this objective and remain intact.

It is thus an object of the present invention to overcome the disadvantages of the prior art seals by providing a single-use tamper-resistant transparent seal designed to permit easy detection of any tampering and to prevent cannibalization.

It is a further object of the invention to provide such a seal wherein the seal is made from an inexpensive material and is easily installed.

SUMMARY OF THE INVENTION

The present invention meets these objectives by providing a single-use seal with a generally hollow transparent pendular body having a central cavity. An opaque locking member is inserted into the cavity and is fixedly connected to the body. One end of a generally U-shaped fastening shackle, reversibly bent to form a tang, is inserted through an opening along the top surface of the body into the central cavity and into locking engagement with both the seal body and the locking member. The other end of the shackle is also reversibly bent to form a tang and is inserted into the cavity and into locking engagement with the body and locking member when the seal is installed on a meter.

Each tip of the shackle lies adjacent to a frangible finger on the locking member within the central cavity of the body. If an excessive tensile force is applied to the shackle in an attempt to forcibly remove it from the body, the finger breaks and falls into the cavity of the transparent body thus revealing any such tampering attempt.

An important advantage of the present invention lies in the fact that even though the finger on the locking member fractures, the seal remains locked, since the shackle tip is retained by both the finger and a catch in the seal body. The locking member is designed to further include two frangible leaves formed by slots in the lower portion of the locking member along its sides. The leaves are intended to reveal tampering when a thin rigid member or "pick" is inserted into the body cavity in an attempt to deform the tip of the shackle so that it may be removed from the body. Such an attempt causes the leaf to break and fall within the cavity thus giving clear evidence of tampering.

The permanent connection of the locking member to the body, the supplementary mechanical retention of the locking member within the cavity by the shackle and the retention of the shackle tips by both the body and the locking member insure that the locking member cannot be removed from the body cavity without fracturing the seal. This provides an advantage in that the seal cannot be opened and then re-installed by cannibalizing parts from other seals.

In the foregoing general description of the present invention certain objects and advantages have been set out. These and other objects and advantages will be apparent from the following detailed description and the accompanying drawings.

DETAILED DESCRIPTION

Figure 1:
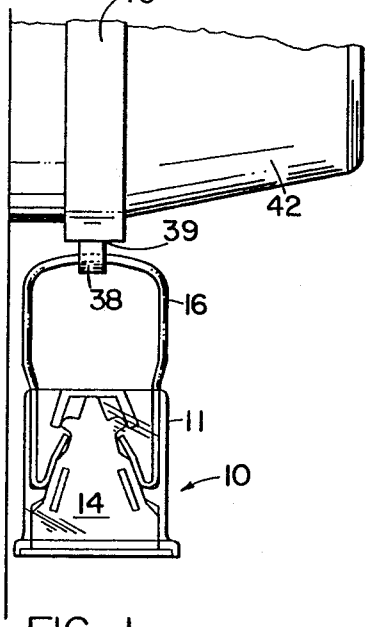
FIG. 1 is an elevation view of the seal of this invention connected to a meter in a locked condition.

FIG. 1 shows the seal of the present invention in operation. The seal, generally designated 10, is inserted through an opening 38 in hasp assembly 39 of the locking ring 40 on a utility meter 42. The seal is illustrated in the locked position which prevents the locking ring from being removed. With the seal in this position, the meter 42 cannot be open and meddled with or reset. As will be explained more fully below, the seal is designed to permit easy detection of any tampering with the seal whether successful or not.

Figure 3:
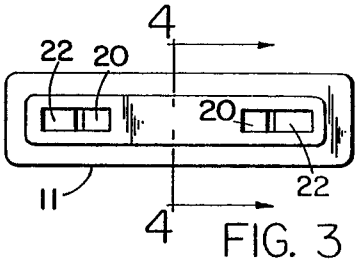
FIG. 3 is a top plan view of the body of the seal in FIG. 1.
Figure 4:
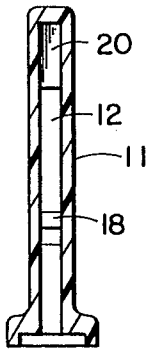
FIG. 4 is a cross-sectional view of the body of the seal as seen along the section line 4—4 in FIG. 3.
Figure 2:
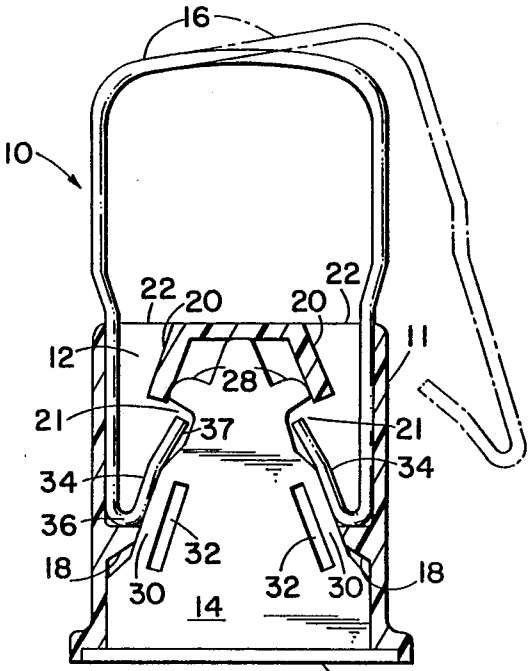
FIG. 2 is an enlarged cross sectional view of the seal in FIG. 1.

FIG. 2 illustrates the seal 10 of the present invention in a closed, locked position (full-line) and an open unlocked position (phantom view). The seal is comprised of a transparent, pendular body 11, an opaque locking member 14 fixed within the body 11, and a U-shaped fastening shackle 16 which is laced through the locking ring of utility meter and is irreversibly secured by the body 11 and the locking member 14 when the seal is closed. The pendular body 11 defines a central cavity 12 extending from the upper surface of the body to the bottom surface of the body. Opposed shoulders 18, 18 extend laterally into the cavity well below the upper surface to limit the downward displacement of the shackle 16. Opposed catchers 20, 20 extend at an angle into the cavity for purposes described further below. FIGS. 2 and 3 illustrate two openings 22, 22 spaced along the upper surface of the body 11 at opposite sides of the catches 20 for insertion of the shackle 16. In the preferred embodiment of the present invention, the body is composed of a transparent plastic material.

The locking member 14 is inserted within the body cavity 12 and substantially fills the cavity below the shoulders 18. The base 26 of the locking member is connected to the base of the body by, for example, sonic fusion which permanently fixes the locking member in place within the cavity 12. Two opposed frangible fingers 28, 28 are formed in the upper part of the locking member and cooperate with catches 20, 20 to center the locking member and to form recesses 21, 21 facing downwardly into the cavity at opposite sides of the locking member. Two opposed frangible leaves 30, 30 are formed by slots 32, 32 in the lower portion of the locking member opposite the shoulders 18 in the body cavity 12. The purpose for the leaves is discussed further below in connection with FIG. 6. In the preferred embodiment of the invention the locking member is composed of an opaque plastic material.

The generally U-shaped fastening shackle 16 has each end reversibly bent into a tang 34. In the preferred embodiment of the invention, the shackle is made of wire which is sufficiently stiff to hold the bent configuration illustrated when placed under slight stress, but the wire is also sufficiently resilient so that the shackle can be flexed from the phantom position to the full line position and be inserted in the body 11 as shown in FIG. 1.

Referring now to FIG. 2, the steps for installing the seal will be explained. One end of shackle 16 (on the left in FIG. 2) is inserted through the corresponding opening 22 in the body 11 and is forced down into cavity 12 until the bend 36 in the tang 34 rests on the shoulder 18. The resiliency of the shackle allows the tang to be flexed as the end of the shackle is inserted in the opening 22 and forced past the catch 20. When the tip 37 of tang 34 clears catch 20, the tang springs back to the illustrated, relaxed position. When the bend 36 of tang 34 reaches shoulder 18 further movement of the end of the shackle is prevented and the tang lies adjacent the frangible leaf 30 of the locking member 14. With the tang lodged in this position, tip 37 of tang 34 lies within the recess 21 adjacent to frangible finger 28 such that the end of the shackle is captured and retained in the body 11 by both the frangible finger 28 and the catch 20. To ensure a positioning of the tip 37 adjacent the frangible finger 28, the tang 34 is not perfectly straight, but includes a slight bend at the midpoint to lean the tip over under the catch 20 and closer to the finger 28.

The second end of the shackle (shown in phantom in FIG. 2) is first laced through the opening 38 in locking ring 40 of the utility meter 42 (shown in FIG. 1). The end of the shackle is then inserted into the cavity 12 at the opposite side of the locking member from the first and is locked in the recess 21 by the respective fingers 28 and catch 20 in the same manner as described above for the first end of the shackle.

Figure 5:
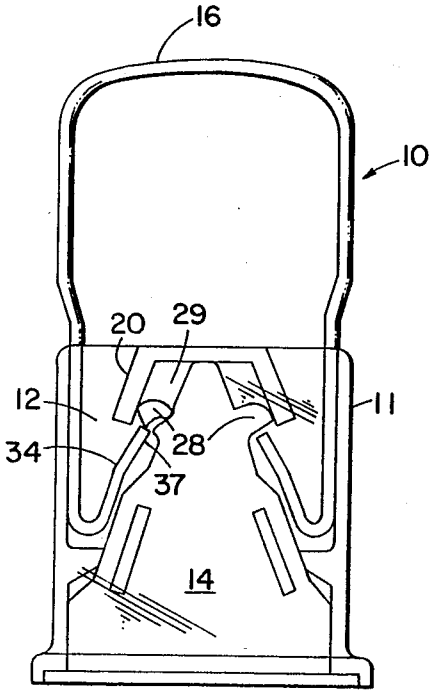
FIG. 5 is a front elevational view of the seal in FIG. 1 and illustrates one type of tampering.

When the seal is installed and locked, the meter cannot be reset or altered without seal tampering being detected. As shown in FIG. 5, if an attempt is made to pull an end of the shackle 16 out of the body by applying a tensile force to the shackle, the tang 34 of the end to which the force is applied bears against frangible finger 28 and causes the finger to break off. The broken finger remains lodged in the notch 29 between the catch 20 and locking member 14 or falls into the cavity and is clearly visible through the transparent body. Moreover, the seal 10 remains locked because the tang 34 is forced up into notch 29 and is retained by the catch 20.

Figure 6:
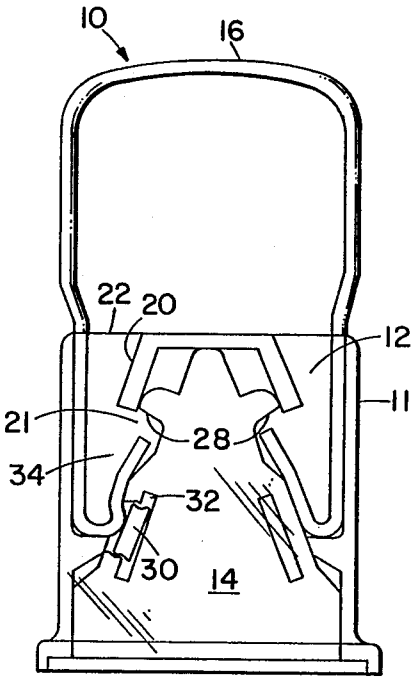
FIG. 6 is another front elevational view of the seal in FIG. 1 and reveals another type of tampering.

As shown in FIG. 6, if a thin rigid member or "pick" is inserted into cavity 12 through one of the openings 22 in an attempt to deform the tang and release the tang from the recess 21 under the catch 20 and the finger 28, frangible leaf 30 fractures. The fractured leaf is also readily visible through the transparent body, but the tang 34 remains captured in the recess 21. Thus, visual evidence of a tampering attempt is again established while the seal remains locked.

The transparency of body 11 also reveals evidence of any attempt to disable or reset the meter by cutting one end of the shackle 16 flush with top surface of the body 11, removing the seal and then reforming a tang on the cut end and reinserting the shackle in the body. The wire cut from the end of the shackle remains lodged in the recess 21 and is clearly visible in the cavity 12 through transparent body 11.

Cannibalization of the seal of the present invention is also not possible. The locking member 14 is permanently bonded to body 11 and is further retained in the body by the shackle 16. This means that any attempt to disassemble the seal by removing locking member 14 from body 11 and reusing these parts results in complete destruction of the seal.

Figure 7:
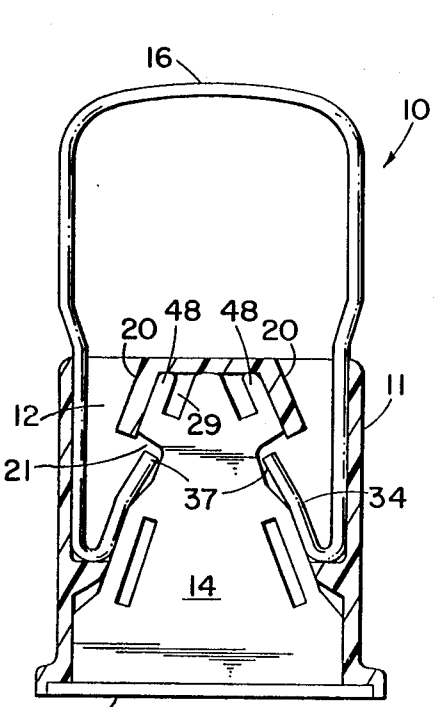
FIG. 7 is a cross-sectional elevational view of a second embodiment of the seal according to this invention.

FIG. 7 illustrates a second embodiment of the present invention in which parts previously described in the embodiment of FIGS. 1–6 bear like reference numbers. In this embodiment the frangible fingers 48, 48 of locking member 14 are bent at a 90° angle to project into notches 29, 29.

The frangible fingers 48, 48 are designed to fracture in the same manner as the frangible fingers 28, 28 shown in the first embodiment of the invention. If an excessive tensile force is applied to an end of the shackle 16, tip 37 bears against a frangible finger 48 causing it to break and fall into cavity 12. Again, evidence of the attempt to unlock the seal is clearly visible through the transparent body 11. Moreover, the seal remains locked as tip 37 is forced up into notch 29 and retained by the catch 20.

It is, of course quite obvious that while certain preferred embodiments of this invention have been illustrated and described, the invention may be otherwise embodied within the scope of the following claims.

We claim:

1. A seal for utility meters and the like comprising:

a generally hollow, transparent, pendular body having two opposed openings in its upper surface leading into a central cavity extending vertically from the upper surface of the body to its lower surface, two opposed shoulders intermediate the top and bottom surfaces of the body extending laterally into the cavity and two opposed catches located in the upper portion of the body in the central cavity;

an opaque, locking member inserted into the central cavity and fixedly connected to the body, the locking member having two opposed frangible fingers cooperating with the catches of the body to form recesses facing downwardly into the cavity at opposite sides of the locking member; and a generally U-shaped fastening shackle, each end of which is reversibly bent to form a tang, one end of the shackle being inserted through one of the openings along the top surface of the body down into the central cavity so that the bend of the tang rests on one of the opposed shoulders and the tip of the tang is secured in one of the downwardly facing recesses adjacent a frangible finger, the other end of the shackle being insertable through the other opening and likewise securable in the downwardly facing recess on the opposite side of the locking member to lock the seal.

2. The seal of claim 1 wherein the body and the locking member are made of plastic.

3. The seal of claim 1 wherein the transparent pendular body is rectangular in shape.

4. The seal of claim 1 wherein the shackle is made of wire.

5. The seal of claim 1 wherein the body and locking member are permanently bonded.

6. The seal of claim 1 wherein the locking member has two opposed frangible leaves formed by slots in the lower portion of the locking member along its sides.

7. The seal of claim 1 wherein the opposed frangible fingers extend at a first angle from the sides of the locking member into the cavity and at a point along their length the fingers bend upwardly at a second angle disposed 90° to the first angle so that the fingers rest against the catches to form recesses facing downwardly into the cavity at opposite sides of the locking member.

8. The seal of claim 1 wherein the opposed frangible fingers cooperate with the catches to center the locking member within the central cavity.

9. The seal of claim 1 wherein the upper portion of the locking member cooperates with the catches to center the locking member within the central cavity.

* * * * *